United States Patent [19]

Amemori et al.

[11] Patent Number: 4,515,120

[45] Date of Patent: May 7, 1985

[54] GOVERNOR FOR INTERNAL COMBUSTION ENGINE

[75] Inventors: Koichi Amemori; Toshihiko Kawabe, both of Takatsuki; Yosuke Takahashi, Kobe, all of Japan

[73] Assignee: Yanmar Diesel Engine Co., Ltd., Osaka, Japan

[21] Appl. No.: 526,069

[22] Filed: Aug. 24, 1983

[30] Foreign Application Priority Data

| | | | |
|---|---|---|---|
| May 16, 1983 | [JP] | Japan | 58-84069 |
| Jun. 21, 1983 | [JP] | Japan | 58-110188 |
| Jul. 27, 1983 | [JP] | Japan | 58-117689[U] |

[51] Int. Cl.[3] ..... F02D 1/04

[52] U.S. Cl. ..... 123/368; 123/373; 123/195 P

[58] Field of Search ..... 123/373, 365, 366, 368, 123/370, 371, 372, 364, 195 P; 440/87, 900

[56] References Cited

U.S. PATENT DOCUMENTS

| | | | |
|---|---|---|---|
| 1,958,751 | 5/1934 | Heidelberg | 123/373 |
| 2,569,346 | 9/1951 | Shively | 123/195 P |
| 4,067,303 | 1/1978 | Aoki | 123/368 |
| 4,397,277 | 8/1983 | Takahashi | 123/368 |
| 4,414,945 | 11/1983 | Bonin | 123/373 |
| 4,426,971 | 1/1984 | Isoda | 123/373 |

FOREIGN PATENT DOCUMENTS

| | | | |
|---|---|---|---|
| 20295 | 2/1978 | Japan | 440/87 |

*Primary Examiner*—Magdalen Y. C. Moy

*Attorney, Agent, or Firm*—Armstrong, Nikaido, Marmelstein & Kubovcik

[57] ABSTRACT

A governor for an internal combustion engine, in which a floating lever rotatably supported by a shaft abuts with its one end against the forward end of the governor spindle, the other end of the floating lever being connected through a link member to a control rod for controlling the fuel injection of the engine, and in which a regulator handle is provided, which is operatively connected to the shaft of a grip of a steering handle.

7 Claims, 9 Drawing Figures

FIG.7
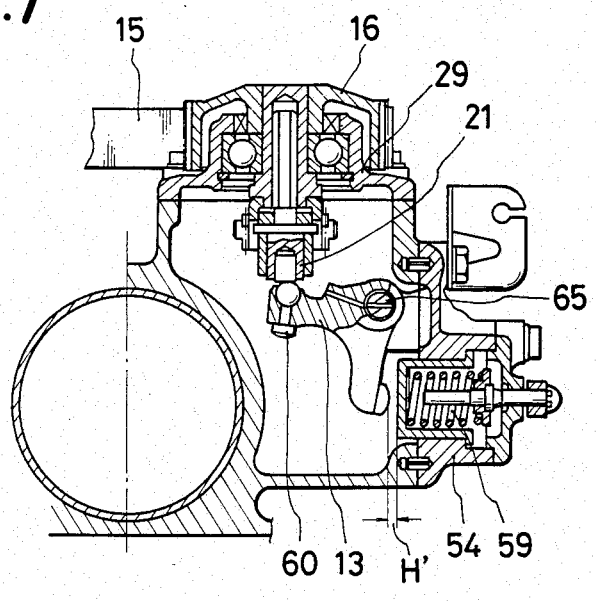
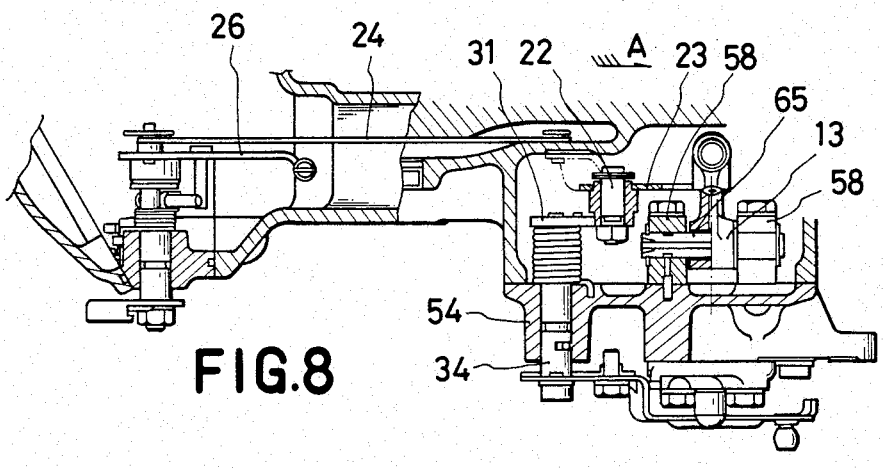
FIG.8

GOVERNOR FOR INTERNAL COMBUSTION ENGINE

BACKGROUND

The present invention relates to a governor for an internal combustion engine and, more particularly, a floating-lever type governor for a diesel engine for an outboard motor.

Generally, outboard-motor internal combustion engines must meet the absolute requirement that they are comparatively light in weight and compact in structure, and conventionally internal combustion engines for use as an outboard motor predominantly comprised gasoline engines.

However, as the price of gasoline has been tremendously raised in recent years, it has been increasingly demanded that in place of a gasoline-type internal combustion engine with which the fuel cost is relatively high, the employment for an outboard motor should be made of a diesel engine with which the fuel cost is comparatively low. With diesel engines, however, the fuel injection control involves more of complexity than with gasoline engines. Besides, in the case of an outboard engine, acceleration and deceleration thereof should necessarily be effected by operating a steering handle disposed to project toward the bow of a ship or boat, and it forms an important requirement that the operation of the handle can be made with ease. Also, in most instances a diesel engine for an outboard motor is housed in a lower and an upper cowlings and it should be met, too, that an inspection operation and/or a maintenance work can be performed simply by removing away or opening the upper cowling.

Further, with conventional outboard diesel engines, it is operated in starting the engine to let fuel be injected about twice as much as the amount at the time of normal engine operation so that the ignition can take place without fail and also in order to rapidly raise the rotation number immediately after the engine has been started.

Then, for the purpose of controlling the engine speed by way of controlling the fuel injection, a governor is incorporated in the internal combustion engine. With conventional centrifugal-type governors, the motion of a governor spindle caused by centrifugal force exerted by a governor weight is transmitted through such as a floating lever, a link and so forth to a control rod for controlling the fuel injection to thereby automatically govern the engine speed. To increase the fuel injection at the starting of the engine, a handle provided separately of the governing or regulator handle is operated.

With the governor of such system, indispensably the arrangement and the operation have to be complex and, in addition, there lies the danger that the operation lever for increasing the fuel injection is in error operated during normal running of the engine, when the engine is caused to operate at a power above the prescribed value and becomes damaged.

In the case of floating-lever type governors in which the motion of the governor spindle caused by centrifugal force of the governor weight is transmitted to the control rod through such as a first lever, a floating lever and a link member and in which almost all of the force is born by the first lever so that no substantial portion of the force may not be transmitted to members following to the link, an idle spring is incorporated to control the rotation number during idling of the engine. The idle spring is imparted with a spring constant such that during idling rotation of the engine, a balancing takes place between the force of the idle spring and that of the governor, and as soon as the rotation number lowers below the idling rotation number, the fuel injection is increased, while when the rotation number tends to come above the idling rotation number, the fuel injection is suppressed.

Preferably, the idle spring should be located as far away the governor as possible: At each joint in the path of transmission of force to the control rod through such as governor spindle, first lever, floating lever, link member, further levers and pins and so forth, there exists an innegligible gap or play, and if the governor is operated in a state where force in a certain direction is not constantly applied to such link or joint portions, the operation of the governor becomes unstable at the link portions. Therefore, preferably it is to be made that the idle spring is provided at the side of the control rod so that force in a certain direction is constantly applied to the joint portions. At the same time, it may be required to adjust the spring force of the idle spring during the engine operation so as to set the rotation number of the engine idling, and the idle spring should necessarily be located at a position affording an access with ease.

Further, in the internal combustion engine for an outboard motor in which the control rod for controlling the fuel injection is provided so as to be movable parallel to a vertically arranged crankshaft, it is utmost preferred to mount a governor at an upper portion of the engine so that an easy access can be made for maintenance, inspection and adjustment operations. Thus, an idle-spring chamber in which to house the idle spring should preferably be disposed in an upper portion of the engine.

In conventional governors, there is included such a one which employs the so-called torque spring system in which compensation of the difference between the force of a governor weight and that of a regulator spring constituting the main spring is effected by the function of a torque spring so that when the engine rotation lowers below a certain value, the fuel injection can be increased. A fuel-injection increasing or controlling mechanism of such torque-spring system may not possibly be employed for a floating-lever type governor in which the force of a regulator spring is born by a first lever and the force born by this lever is almost in balance with the force of a governor weight and in which the force of the regulator spring is not transmitted to links and a lever for operating a control rod for controlling the fuel injection which are arranged downstream of a floating lever in the direction of the force transmission.

SUMMARY

A first object of the present invention is to provide a governor for a diesel engine for an outboard motor which can be operated with only a small operation force and by operating a grip of a steering handle, to accelerate and decelerate the engine rotation.

A second object of the invention is to provide a governor for a diesel engine for an outboard motor of which a structually complex mechanism for securely governing the fuel injection is made lighter in weight and in a compact manner incorporated in the engine and of which maintenance and/or inspection operation can be easily performed.

A third object of the invention is to provide a floating-lever type governor for an internal combustion engine in which the force of a regulator spring is not transmitted to a link and a lever for operating a control rod for controlling the fuel injection which are arranged following to a floating lever in the direction of the force transmission and which can let the fuel injection be automatically increased only at the starting of the engine to thereby improve the starting performance of the engine.

A fourth object of the invention is to provide a floating-lever type governor for an internal combustion engine for an outboard motor of which the performance is stabilized and which permits operations for maintenance, inspection and/or adjustment to be performed with ease.

The above recited first and second objects of the invention can be attained by providing in accord with the invention such a floating-lever type governor for an internal combustion engine in which the motion of a governor spindle is transmitted through a floating lever and a link member to a control rod for controlling the fuel injection of the engine and of which a regulator handle is operatively connected to the shaft of a grip of a steering handle.

The above recited third and fourth objects of the invention can be attained by providing in accord with the present invention such a floating-lever type governor for an internal combustion engine which comprises a governor weight and a governor spindle and in which the force of the governor weight is born by a regulator spring which abuts against one end of a first lever operatively associated with the governor spring, the first lever abutting with its other end against a floating lever.

In accordance with a particular aspect of the invention, the third and fourth objects of the invention can be attained also by providing such a floating-lever type governor for an internal combustion engine which comprises a control rod for controlling the fuel injection of the engine, an idle spring constantly actuating the control rod in the sense of increasing the fuel injection, the idle spring having a spring constant such that while a balancing taking place between the force of the spring and that of the governor, the engine can continue rotation at the idling rotation number, and which further comprises an auxiliary spring for lifting the control rod through the idle spring up to a position for causing a maximum fuel injection to occur only during the stoppage of the engine, whereby during the time when the governor force is relatively small such as at the outset of the engine start, the fuel injection can be automatically increased.

Further objects, features and advantages of the present application will become apparent from considering the following detailed description of the preferred embodiments, taken in conjunction with the accompanying drawings.

THE DRAWINGS

Figure 6:
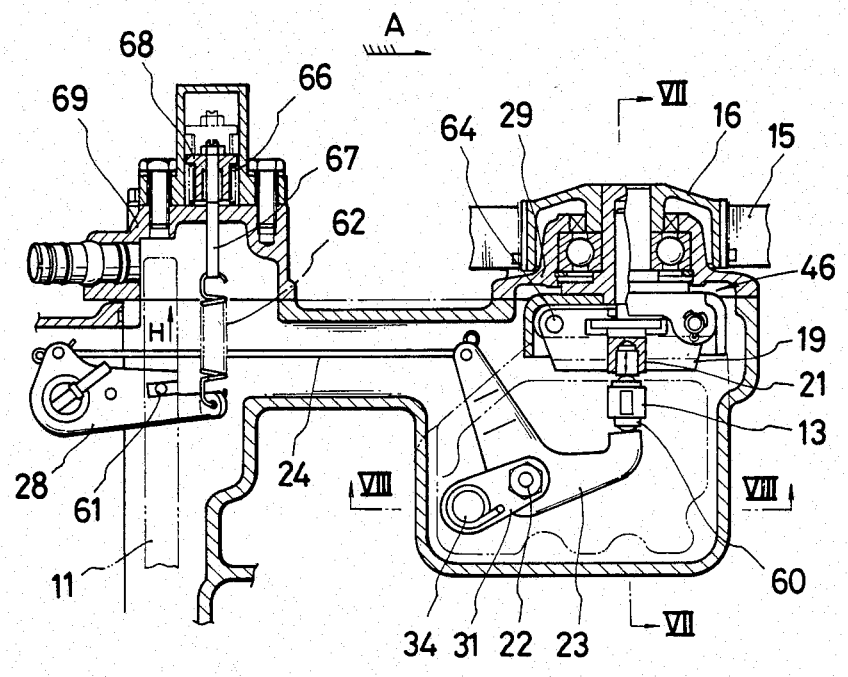
Figure 9:
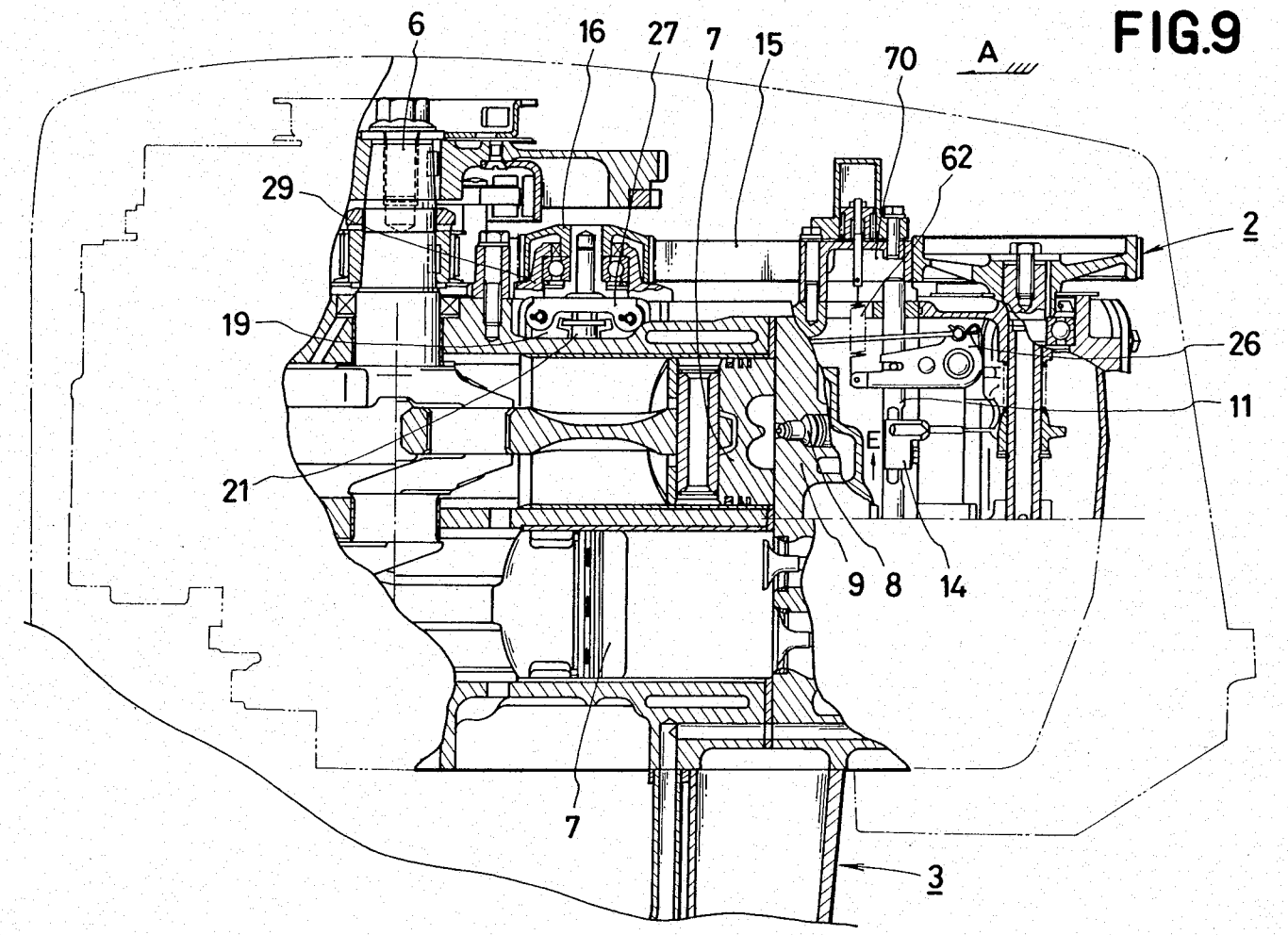

FIGS. 6 to 8 in combination represent a third embodiment of the invention, of which FIG. 6 is a sectional side elevational view, showing in enlargement the floating-lever type governor of the third embodiment, FIG. 7 shows a sectional view, taken on line VII—VII in FIG. 6, and FIG. 8 is also a sectional view, taken now on line VIII—VIII in FIG. 6; and FIG. 9 represents a fourth embodiment of the invention and shows a sectional side elevation, taken for illustration in enlargement of essential portions inside of a diesel engine.

PREFERRED EMBODIMENTS

Figure 1:
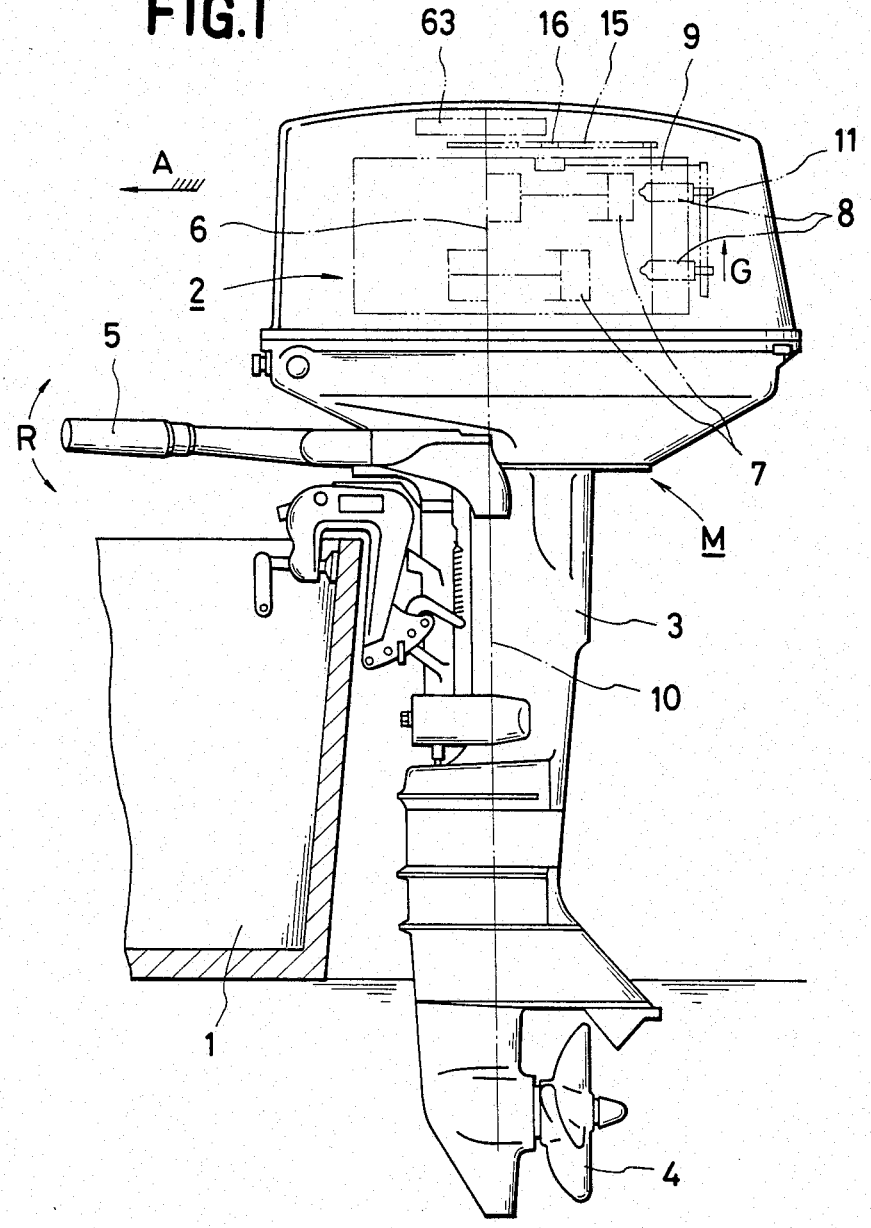
FIG. 1 is a schematic side elevational view, taken for a general understanding of an outboard-motor diesel engine incorporating a governor according to the invention, mounted at the stern of a small-sized ship or boat.

Initially referring to FIGS. 1 to 4, which in combination represent a first embodiment of the present invention, it will be seen from FIG. 1 in particular that at the stern of a small-sized ship or boat 1, securely mounted is an outboard motor M, which broadly comprises an internal combustion engine, namely a diesel engine 2 and a drive unit 3. By the engine 2 and through a propeller shaft 10 which is vertically housed in the drive unit 3 and connected to a crankshaft 6, a propelling screw 4 is driven to rotate so as to propel the boat 1 in the direction shown by an arrow A. For the steering of the boat 1, a steering handle 5 is provided to project toward the bow in a manner capable of being operated toward the starboard and the port on the boat.

With the present internal combustion engine 2, the crankshaft 6 comprises a vertically supported shaft and accordingly pistons 7 of the engine are so arranged as to horizontally reciprocate: As can be best seen from FIGS. 1 and 2 in combination, facing combustion chambers located at the top side of pistons 7, unit injectors 8 are mounted in the cylinder head indicated at 9, and responsive to combustion of fuel injected by injectors 8, pistons 7 undergo reciprocating motion slidably along the cylinder liner shown at 12 to thereby rotate the vertically disposed crankshaft 6 and, through the drive unit 3, the propeller screw 4 as before mentioned.

Figure 3:
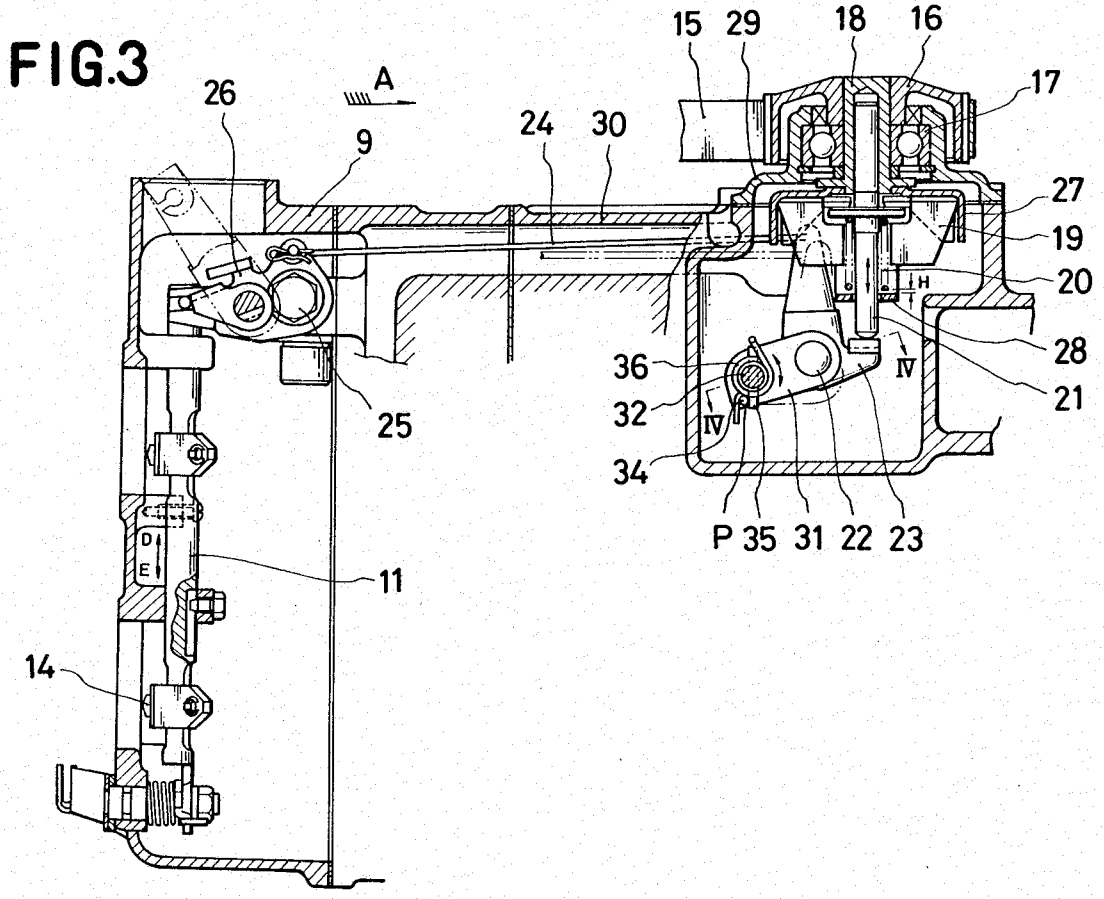
FIG. 3 is a sectional side view, taken from the rear side of FIG. 2 and showing in enlargement essential portions of a floating-lever type governor according to a first embodiment of the invention.

Each unit injector 8 is incorporated with a lever for controlling the injection amount of fuel, which is not shown but can be secured to a plunger (not shown) and may be arranged so that by a fork 14 secured to a control rod 11 vertically movable in directions D and E of a bidirectional arrow in FIG. 3, which are parallel with the axis of the crankshaft 6, it may be operated to rotate in the directions D and E respectively for decreasing and for increasing the injection amount of the fuel.

In an upper portion, the internal combustion engine 2 is incorporated with a floating-lever type governor embodying the present invention. As shown in FIG. 3, which shows an enlarged partial side elevation in section viewed at from that side or the rear side of FIG. 2, a governor pulley 16 which is rotated through a timing belt 15 is rotatably supported by a bearing 17, and lower to a governor shaft 18 rotatable with the governor pulley 16, mounted are such as a governor weight 19, governor spring 20 and a vertically slidable governor spindle 21. An arrangement is made as follows:

When the governor weight 19 is put into its open position in accordance with rotation of the engine 2 causing the governor to operate, the governor spindle 21 undergoes lowering in its position, whereby a floating lever 23 is rotated with a shaft 22 as the fulcrum of the motion. Then, through a control lever 26 which is mounted in the cylinder head 9 located at the left side in FIG. 3, in a manner capable of being rotated with a shaft 25 as the fulcrum for the rotation, and which is coupled to the floating lever 23 through a link member 24 which in turn is connected to an end of the lever 23, the up and down motion of the spindle 21 is transmitted to change the position of the control rod 11 for example in the direction D for then reducing the injection amount of the fuel.

In the floating-lever type governor structured as above, the spring force of the governor spring 20 born by a spring stop 28 integrally structured with the governor housing indicated at 27 and the centrifugal force of the governor weight 19 can in combination function as inwardly directed force, so that the amount of motion or change in position of the spindle 21 can change in proportion to a change in the rotation number of the engine 2. With this governor, further, this can be preparatively set to a cover member 29, and simply by way of adjusting a gap H between the governor spring 20 and the spring stop 28 (FIG. 3), assemblage of the governor can with ease be accomplished. A governor assembly thus prepared can be easily mounted in an upper end portion of a cylinder block 30 of the internal combustion engine 2.

Figure 4:
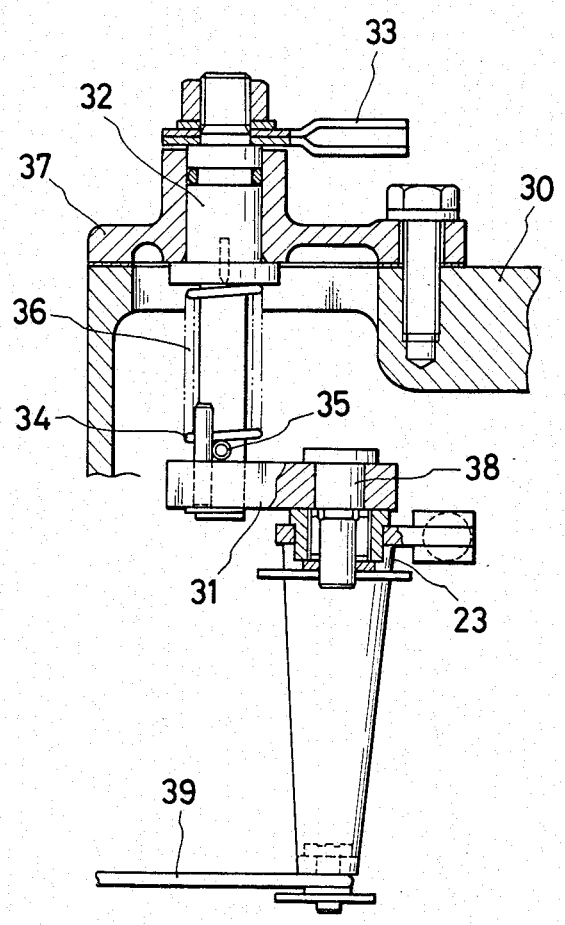
FIG. 4 shows a partial sectional view taken on line IV—IV in FIG. 3.

Then, as shown in FIG. 4 showing a sectional plan view taken on line IV—IV in FIG. 3, the shaft 22 supporting the floating lever 23 is rotatably secured to a regulator lever 31, which in turn is connected to a regulator-lever shaft 32 having a regulator handle 33 attached thereto.

Between a pin 34 mounted on the regulator lever and a pin 35 mounted on the regulator-lever shaft 32, a torsion spring 36 is disposed, which exerts a spring force to bias the regulator handle 33 to its position for decelerating the engine. Thus, by the function of the spring 36, the pins 34 and 35 are normally in a mutually contacting position as indicated at P in FIG. 3. All parts associated with the regulator lever 31 such as the spring 36 can be preparatively assembled on a cover member of a regulator-handle support 37, and in the form of an assembled unit, mounted at an upper side portion of the cylinder block 9.

The regulator handle 33 is connected to the steering handle 5 located in a stern portion of the ship or boat 1 (FIG. 1) through a Bowden wire (not shown) so that by rotating a grip of the steering handle 5 about the axis of the latter in directions shown by an arrow R in FIG. 1, it may be operated to cause the regulator lever 31 to rotate, whereby the position of a shaft 38 of the lever 31 undergoes a change in position and, through a link member 39 and the control lever 26, the control rod 11 undergoes motion to effect acceleration or deceleration of the engine.

Generally speaking, if acceleration and deceleration of an internal combustion engine is effected through the operation of a regulator handle such as the one shown at 33 with use of a floating-lever type governor such as the one described above, the force required for this operation can be only small. With use of the floating-lever type governor according to the present invention in an internal combustion engine, the operation in reference can be effected simply by way of rotating a grip of the stearing handle 5, which can be worked only with an extremely limited operation force, so that ease of the operation for acceleration and deceleration of the engine can be enhanced. That is to say, according to the present invention, the operation for accelerating and decelerating the engine can be smoothly and at an improved efficiency performed simply by rotating the operation grip of the steering handle.

From the viewpoint, among others, of making the drive system lighter in weight and smaller in size, it is generally requred of outboard-motor engines that they can operate rotation at a high velocity and produce a high output at a low torque. On the other hand, in case of the use of a dog clutch in the drive system as is generally practiced, there lies a difficulty in raising the minimum rotation number of the engine. Thus, in the case of outboard-motor engines, the range of working rotation numbers should necessarily be broader in comparison to the cases of engines for other than an outboard motor. With the conventionally widely utilized all-speed mechanical type governors, an extremely high power is required for operating the regulator handle during a high speed navigation, and they can hardly be operated with use of such an operating grip as generally made use of in the case of outboard motor engines. Thus, there is a demand made for a governor arrangement as proposed according to the present invention.

With conventional governor devices, the power required for the operation of them increases in proportion to the square of the rotation number, and for example in the case of an engine of 800–5000 rpm as required with outboard motor engines, providing that the required operation power during rotation at the lowest rotation number is constant, the maximum required operation power is 1.92 times as great as that in the case of an engine of 800–3600 rpm:

$$\frac{(5000/800)^2}{(3600/800)^2} = \left(\frac{5000}{3600}\right)^2 = 1.92$$

In connection with the operation power during rotation at the lowest rotation number, this should necessarily be of a (constant) lowest required value so that the governor can operate as such at the time of the lowest rotation number.

Taking the above into account, it is feasible to make use of the diesel engine of which complex is the fuel injection control mechanism for an outboard-motor internal combustion engine.

Now, in cases of overhead cam type diesel engines, it is possible to mount the camshaft directly on top of the cylinder center. According to the present invention, however, it is devised that in order to reduce the total length of the engine so as to make it adapted for use as an outboard-motor engine, a camshaft 41 (FIG. 2) is disposed at as low a position as possible relative to the cylinder head 9, and in addition, the unit injectors 8 are disposed at an inclination to lie relatively close to the camshaft 41 and operated through rocker arms.

Figure 2:
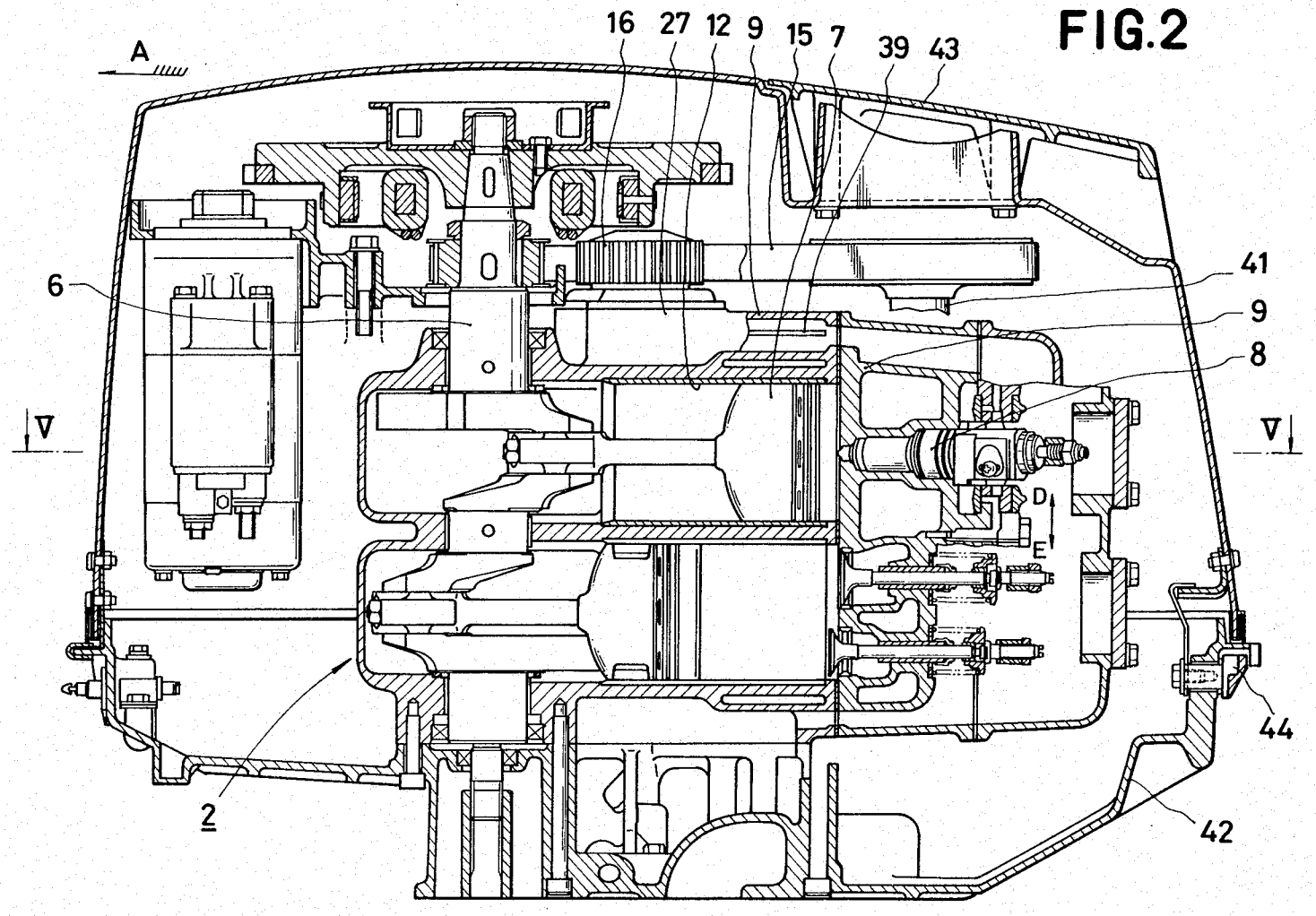
FIG. 2 shows in enlargement a sectional side view of the inside of the diesel engine of FIG. 1.

As shown in FIG. 2, further, the internal combustion engine 2 is enclosed by a lower cowling 42 and an upper cowling 43. Whereas the lower cowling 42 is fixed at a portion of the drive unit 3, the upper cowling 43 is mounted in a manner capable of being removed away with ease by releasing a fixing handle 44, so that with this upper cowling 43 opened, operation can be readily carried out for such as inspection, maintenance and so forth.

Thus, according to the present invention, it advantageously is feasible to preparatively set the structurally complex governor and regulator handle mechanism to their respective cover members and mount them, in their state of thus preset assembly, at an upper portion of the cylinder block. Advantageously, the number of assembling steps can therefore be reduced, and any required adjustment operations can be performed with ease and at accuracy. Also, as before stated, inspection and/or maintenance of the governor can easily be operated simply by opening the upper cowling.

Figure 5:
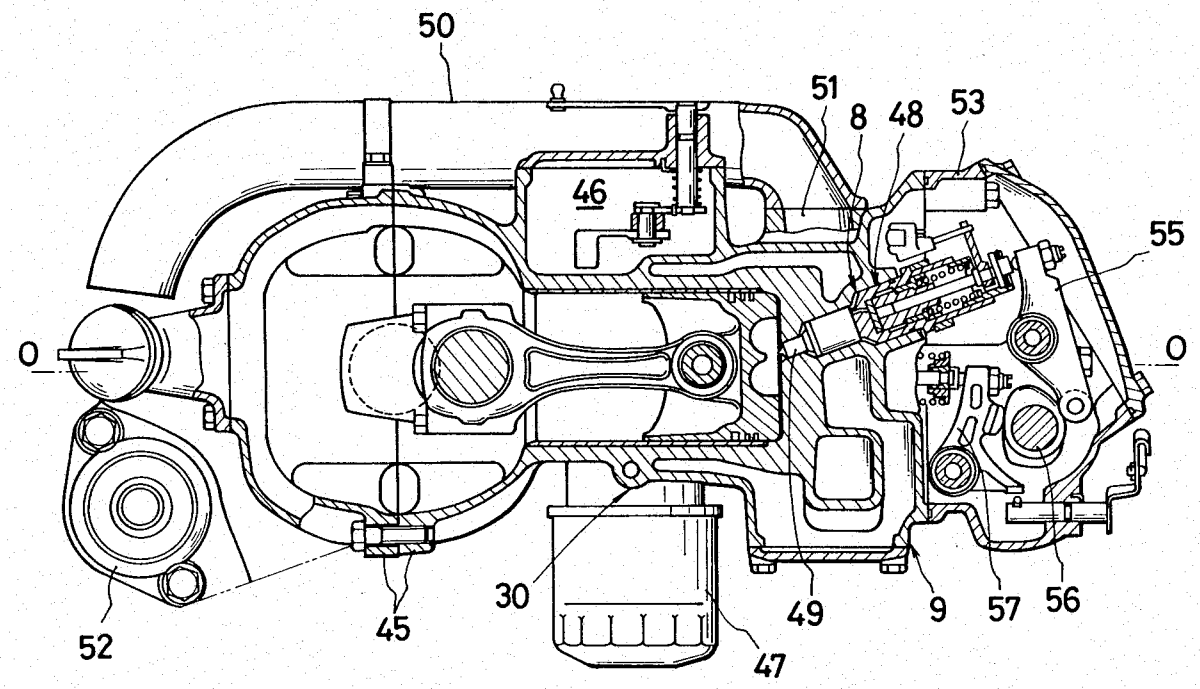
FIG. 5 is a sectional view, taken on line V—V in FIG. 2 and represents a second embodiment of the invention.

Now, transferring reference to FIG. 5, which shows a sectional view taken on line V—V in FIG. 2 and represents a second embodiment of the invention, a governor 46 is provided rear of and adjacent to a crankcase 45, at the right side of the cylinder block 30, and at the left side of the block 30, there is disposed an oil filter 47. Fuel injection pumps 48 are together with nozzles 49 made unit injectors and mounted to the cylinder head 9 again in a built-in form. In the illustrated internal combustion engine 2, out of all relatively large-size members to be incorporated to the engine, the fuel injection pumps 48 are set to the cylinder block 9 and, in addition, the governor 46 and the oil filter 47 are separated in location to right and left of the cylinder block 30, so that the engine as a whole takes a generally oval configuration in plan as seen from FIG. 5, which is suitable for the engine configuration for an outboard motor. Further, the whole of the engine is covered by a case (not shown). In FIG. 5, the reference character 50 denotes an air intake pipe, of which one end is in communication with an intake port 51 in a right side wall portion of the cylinder head, while the other end opening in the vicinity of the crankcase 45. This air intake pipe 50 is extended along the right side face of the cylinder block 30 and the crankcase 45, and its inlet opening portion is curved along a front end portion of the crankcase 45 to reach the vicinity of the center plane O—O. By providing such elongate air intake pipe 50, it is advantageously feasible to enhance the inertia effect of intake air column and thus improve the engine performance.

In addition to the above arrangement in which the air intake pipe 50 is in an end portion thereof curved to reach a point in front of the crankcase 45, a starter 52 is so disposed as to lie at a point diagonally left front of the crankcase 45, therefore the engine can as a whole be in balance with respect to its left and right halves. In a valve arm case 53, the unit injector 8 is disposed to project in the right side and a valve arm 55 is placed in a central portion, while such as a camshaft 56 and a valve arm 57 are disposed at the left side, whereby the valve arm case 53 again is in balance with respect to its left and right half portions.

In the second embodiment of the invention considered above, the crankshaft 6 extends in the vertical direction and the engine is mounted on a ship or boat in a position in which its cylinder axis extends along the axis of the ships hull, while the governor 46 and the oil filter are disposed one and the other at one and the other sides of the cylinder block 30, so that the engine as a whole can have a compact structure having a configuration generally resembling an oval comprising left and right half portions in balance. Thus, according to the present invention, such an outboard-motor engine can be obtained which is comparatively light in weight and small in size and yet has a high output. Further, the fuel injection pump 48 is preparatively set in the cylinder head 9 to provide the structure of the unit injector 8 as before stated, whereby compactness of the engine can be further enhanced.

FIGS. 6 to 8 in combination represent a third embodiment of the present invention, which in particular is concerned with an improved structuring of the governor of the type considered above.

With the governor 46 of the present embodiment, when it is rotated and the governor weight 19 is therefore brought into an open position, the governor spindle 21 becomes forced toward below in FIG. 6. Whereas the motion of the governor spindle 21 is born by a first lever 13 against which the former abuts, as shown in FIGS. 7 and 8 this first lever 13 is rotatably supported at its one end by a shaft 65 through two support members 58 secured to a governor cover 54, while it is in abutment at its other end with a regulator spring 59 mounted in the governor cover 54, so that the lever 13 is in balance in its position by the force of the governor weight 19 and the load of the regulator spring 59.

At its end opposite the end at which it abuts against the governor spindle 21, the first lever 13 is provided with an abutting metal 60, against which one end of the floating lever 23 constituting a second lever abuts, while the other end of the lever 23 being connected to the control lever 26 through the link 24 (FIG. 6).

As described above and as can be seen from FIG. 6, according to the present embodiment of the invention such an arrangement is provided as comprising a governor weight 19 and a governor spindle 21 alone and having, between the governor spindle 21 and the floating lever 23, only the arm portion of the lever 13 having abutting metals 60 on its front and rear faces, so that according to the present invention the length particularly in the axial direction can be remarkably reduced in comparison to conventional floating-lever type governor structure in which springs are provided about the governor weight.

While it is connected through a pin 61 to the control rod 11 for effecting increase and decrease in the amount of fuel injected from the unit injectors 8, the control lever 26 is always biased by an idle spring 62 toward the side for increasing the fuel injection as depicted by an arrow H and, in consequence of this, the floating lever 23 constantly exerts its function in the direction of pressing the first lever 13.

Whereas the first lever 13 therefore undergoes motion while a balance is met of the force of the governor spindle 21 and that of the regulator spring 59, in accordance with such motion of the lever 13 the floating lever 23, too, undergoes motion together with the control rod 11 as well.

The idle spring 62 is of a lower spring force than the regulator spring 59, and it therefore is made that most of the force generated by the centrifugal force of the governor weight 19 is born by the regulator spring 59.

The shaft 22 providing for the fulcrum for the rotation of the floating lever 23 is provided to the regulator lever 31 shown in FIG. 6, which is rotated about the pin or regulator-lever shaft 34 to cause a change in the position of the shaft 22, and it is devised that the fuel injection from the unit injector 8 can be adjusted to increase or decrease externally by operating the regulator lever 34. The regulator-lever shaft 34 is set in the governor cover 54 as shown in FIG. 8.

In the floating-lever type governor 46 of the present third embodiment of the invention, the regulator spring 59 which in conventional governors is disposed about the governor weight 19 is placed outside a peripheral portion of the governor weight, whereby the structure around the governor weight can be simplified and made compact. Now that the height of the governor 46 can be reduced, the height of the internal combustion engine 2 in the axial direction of the crankshaft 6 can be reduced. Further, the position for mounting a flywheel 63 as shown in FIG. 1 on top of the crankshaft 6 can also be lowered.

The governor 46 of the present embodiment is structurally characterized also in that the force is mainly born by the first lever 13 with little force transmitted to other members such as the link 24 and so forth. Also, according to the invention it is made to preparatively set to the cover member 29 the whole members of the governor 46 such as governor weight 19 and governor spindle 21 and also a weight support 64 to there provide a built-in structure of the governor; not only that, but is it also made to similarly set to the governor cover member 54 before the assemblage of the engine, all such members as a shaft 65 for supporting the first lever 13 operatively associated with the governor spindle 21, the regulator spring 59 to abut against the first lever 13, and the regulator-lever shaft 34 for variably supporting the rotation center of the floating lever 23 associated in operation with the governor spindle 21 through the first lever 13 and transmitting the motion of the spindle 21 to the control rod 11 to operate the latter to increase or decrease the amount of fuel injection from the unit injectors 8. Accordingly, after such setting of various members, an adjustment operation may scarcely be required.

Now that in an outboard-motor engine incorporating the governor according to the present invention the length of the vertically directed crankshaft can be reduced, if a flywheel is mounted at the top end of the crankshaft, the eccentric load on the main bearing for the crankshaft can be suppressed, and the whole structure of the engine can be advantageously made compact and light in weight.

Further, with the governor according to the invention, it is possible to operate a pre-machining so as to adapt it to particular governor mount, therefore mounting of the governor relative to the engine can be performed at rapidity and with ease. Also, any required adjustment after the mounting of the governor can be easily operated. Thus, the present invention is highly useful in the case of mass-production of internal combustion engines.

Now, an explanation will be given the operation of the floating-lever type governor 46 according to the invention. As the engine 2 commences rotation, the governor spindle 21 may undergo lifting. At the outset of starting of the engine, there is the gap H' of about 3 mm present between the first lever 13 and the regulator spring 59 (FIG. 7), and during a time before this gap H' becomes cancelled, the force of the governor weight 19 and that of the idle spring 62 are in balance, when the governor performs governing at the time of idling rotation. As the rotation number then increases, the force of the governor weight 19 becomes greater, only when the regulator spring 59 commences functioning through the first lever 13.

The regulator spring 59 is imparted with a certain setting load, and until the rotation of the internal combustion engine 2 arrives at a certain prescribed number and the force of the governor then exceeds a certain value, the regulator spring 59 remains inoperative, and during such time, the floating lever 23, too, remains inoperative, when the governor remains in a condition of operating no governing, and it may be referred to as the so-called maximum-minimum governor.

As the rotation of the engine 2 then arrives at a greater value, the force of the governor will exceed the setting load imparted to the regulator spring, when the governor spindle 21 undergoes lifting and the regulator spring 59 commences contraction, whereby through the floating lever 23, link member 24 and control lever 26, the control rod 11 performs operation to suppress the fuel injection and the maximum rotation number of the engine 2 becomes restricted.

With the engine 2 in idling condition, the regulator spring 59 is in the inoperative condition and, while a balancing taking place between the force of the idle spring 62 and the governor force, it occurs that as soon as the rotation number of the engine lowers a certain value the fuel injection amount is increased, while as soon as the rotation number exceeds a certain value on the other hand, the fuel injection is suppressed. It will be readily understood that the idle spring 62 can be imparted with a spring constant enough great to realize such idling rotation number as mentioned above.

In practice, however, friction occurs in the link system comprising such as the control lever 26, link member 24 and floating lever 23, and in order to enable the spring 62 to be operative overcoming the friction, the spring constant to be had of the spring 62 should necessarily be of a certain great value. Otherwise, it will be difficult to realize such an idling condition as mentioned above, and taking the above into consideration, the spring constant of the idle spring 62 must be determined.

Also, at the time of the idling rotation of the engine, the governor force is extremely small, so that with the engine 2 in a stopped condition, that is, at the starting of the engine, the amount in which the idle spring 62 can contract indispensably tends to be relatively small and the fuel injection tends to be insufficient at the starting of the engine. Taking this point into consideration, it is devised according to the present invention to series connect to the idle spring 62 an auxiliary spring 66 through a hook 67 and an adjustor 68, this spring 66 being of a smaller spring constant than the idle spring 62 and functional to increase the fuel injection at the starting of the engine.

The spring 66 is set at a load such that in the condition in which the adjustor 68 abuts against the idle-spring mount 69, it is smaller than the sum of the governor force at the idling time and the weight of the link system but greater than the weight of the link system.

Thus, in a condition where the internal combustion engine 2 rotates at a rotation number exceeding the idling rotation number, the adjustor 68 is brought to abut against the idle-spring mount 69 and the spring 66 can no longer functin as a spring, and in that condition, this spring can only exert its own spring constant.

Then, during stoppage of the engine, the spring 66 compensates for the shortage in contraction of the idle spring 62 and, until the control rod 11 comes to abut against the idle-spring mount 69, urges the rod 11 in the direction E for increasing the fuel injection, so that the control 11 is caused to reach a position where a maximum fuel injection is arrived at, whereby the starting of the engine can be effected with certainty and at rapidity.

The arrangement for lifting the control rod 11 through the idle spring 62 up to the position for maximum fuel injection only during stoppage of the engine 2 may not be limited only to the above described one comprising such as the spring 66, hook 67, adjustor 68 and idle-spring mount 69, but it may comprise any of various other arrangments.

For example, as shown in FIG. 9 it may be devised to form an idle-spring chamber 70 in an upper portion of the cylinder head 9, above the control rod 11 and have the idle spring 62 housed in such chamber 70, whereby an extremely easy access to the idle spring 62 can be obtained.

By applying the idle-spring arrangement according to the present invention to an internal combustion engine having a floating-lever type governor, the operation of the governor can be stabilized. Since the idle-spring chamber is formed in an upper portion of the cylinder head according to an aspect of the invention, inspection, maintenance and adjustment of the fuel-injection control system can be worked with extreme ease.

When the idle-spring chamber is disposed in an upper portion of the cylinder head as above, it becomes feasible to take a breathing from above the idle-spring chamber to provide a breather outlet above the chamber. From such high position, the blow-by gas can be discharged in a condition of being substantially free of oil residue or of comprising air alone, so that undesirable discharge of oil out of the engine can be effectively prevented from occurring.

As described in detail above, the present invention provides a governor in an internal combustion engine in which the motion of the governor spindle is transmitted through a floating lever and a link member to a control rod for controlling the fuel injection, and according to the invention, the regulator handle of the governor is operatively associated with a grip of the steering handle of a ship or boat so that simply by operating the grip which requires no great force for operation, acceleration and deceleration can be operated with ease and at accuracy, whreby the efficiency of the engine operation can be remarkably enhanced.

According to the present invention, further, the governor can be made lighter in weight and more compact in structure than conventinal comparable devices, and this governor can be in a compact manner incorporated in an internal combustion engine. Thus, the invention can enhance the operation efficiency for the engine mounting and simplify the operation for inspection and maintenance of the engine.

According to a further aspect of the invention, it is feasible to let the fuel injection be automatically incrased only at the starting of the engine, whereby the engine starting efficiency can be improved.

We claim:

1. A governor for an internal combustion engine for an outboard motor, of an arrangement in which the motion of a governor spindle is transmitted through a floating lever and a link member to a control rod for controlling the fuel injection of the engine, wherein said governor has a regulator handle operatively associated with a shaft of a grip of a steering handle of said outboard motor.

2. A governor for an internal combustion engine for an outboard motor, wherein said governor and a timing belt for driving a camshaft of said engine are disposed at an uppermost portion of a cylinder block of said engine, and said governor and a regulator handle, operatively associated with a shaft of a grip of a steering handle of said engine, are preparatively set to respective cover members of said engine prior to being mounted on said cylinder block.

3. A governor as claimed in claim 1, wherein said engine is of the unit injector type, said governor and an oil filfer of said engine are separately disposed on one and the other sides of said cylinder block, and an air intake pipe of said engine is disposed rearwardly of said governor.

4. A governor for an internal combustion engine for an outboard motor comprising a governor weight and a governor spindle, a first lever operatively associated at a first end with said governor spindle, a shaft supporting said first lever, a regulator spring abutting against a second end of said first lever, a floating lever abutting against said first end of said first lever, and a regulator-lever shaft variably supporting a rotation fulcrum of said floating lever, wherein the force of said governor weight is borne by said regulator spring

5. A governor as claimed in claim 4, wherein said governor weight and said governor spindle are set on a governor mount, and said first lever, said shaft supporting said first lever, said regulator spring and said regulator-lever shaft are preparatively set on a governor cover member.

6. A governor for an internal combustion engine for an outboard motor, comprising a control rod for controlling the amount of fuel to be injected, an idle spring urging said control rod in a direction of increasing the fuel injection, said idle spring having a spring constant such that while a balancing is taking place between the force of said idle spring and the force of said governor said engine can continue rotation at its idling rotation number, and an auxiliary spring for lifting said control rod through said idle spring up to a position for maximum fuel injection only during the storage of said engine, said idle spring and said auxiliary spring being connected in series through a hook and an adjuster, whereby, when said governor force is relatively small, such as the outset of the engine start, said fuel injection can be automatically increased.

7. A governor as claimed in claim 6, wherein said idle spring is housed in a chamber which is provided in an upper portion of a cylinder head of said engine above said control rod.

* * * * *